United States Patent [19]

McKann

[11] 4,185,417

[45] Jan. 29, 1980

[54] WEATHER SEAL APPARATUS

[75] Inventor: Henry S. McKann, Fredericksburg, Va.

[73] Assignee: General Products Company, Inc., Fredericksburg, Va.

[21] Appl. No.: 939,193

[22] Filed: Sep. 5, 1978

[51] Int. Cl.[2] ..... E06B 1/70

[52] U.S. Cl. ..... 49/470; 49/488

[58] Field of Search ..... 49/470, 478, 488

[56] References Cited

U.S. PATENT DOCUMENTS

| | | | |
|---|---|---|---|
| 3,604,152 | 9/1971 | Protzman | 49/470 |
| 3,824,246 | 12/1974 | McAllister | 49/470 |

*Primary Examiner*—Kenneth Downey

*Attorney, Agent, or Firm*—Roylance, Abrams, Berdo & Farley

[57] ABSTRACT

A sweep for the bottom of a swingable door includes an L-shaped elongated member having an elongated tube extending along the upper surface of the horizontal portion and a plurality of resilient ribs extending downwardly therefrom. The sweep is mounted on a door by attaching the vertical leg to the inner surface of the door with the tube between the bottom edge of the door and the horizontal leg. The depending ribs contact and are bent by contact with a sill at the bottom of the opening in which the door is mounted. The sweep is usable on inwardly or outwardly swinging doors.

4 Claims, 5 Drawing Figures

WEATHER SEAL APPARATUS

This invention relates to an improved apparatus for providing a weather seal for a swingable closure.

BACKGROUND OF THE INVENTION

It is common practice to provide some form of seal at the margins of a closure such as a door, especially with an "outside" door one side of which is exposed to the weather. A particular problem exists at the bottom of the door which usually has a sill or threshold as part of the doorway opening and a cooperating member which is attached to the door itself and is movable therewith. Because the sill is subject to considerable wear, it is advantageously made of a hard, wear-resistant material. The movable member attached to the door, sometimes called a "sweep," must therefore be formed from a relatively flexible material in such a way that it cooperates with the sill to exclude wind, rain and the like.

Various efforts have been made to provide sill and sweep combinations which perform the necessary functions and are reasonably easy to install and durable. Examples of elements and combinations of these are found in the following patents:

U.S. Pat. No. 1,379,910; Glaser
U.S. Pat. No. 1,530,717; Foote
U.S. Pat. No. 1,795,853; Glass
U.S. Pat. No. 2,089,380; Kammerer
U.S. Pat. No. 2,167,958; Oftedal et al
U.S. Pat. No. 2,949,651; Hill
U.S. Pat. No. 3,273,287; Pease, Jr.
U.S. Pat. No. 3,323,256; Reahard et al
U.S. Pat. No. 3,374,580; Ruff
U.S. Pat. No. 3,900,967; Bursk et al However, these structures exhibit numerous shortcomings and, generally, are quite difficult to install on existing door structures. Common disadvantages are the need to alter the configuration of the door bottom to receive the sweep portion and the relative lack of adjustability to accommodate varying gaps between sills and door bottoms.

BRIEF DESCRIPTION OF THE INVENTION

Accordingly, an object of the present invention is to provide a sweep which is easily installable, is adjustable in height to properly and effectively cooperate with a sill to exclude external weather conditions and is durable and can be economically produced.

A further object is to provide a sweep which can be mounted, without modification, on doors which are swingable either inwardly or outwardly relative to the space to which the closure permits access.

Another object is to provide sill structures which are durable and which are formed to cooperate with a sweep to exclude external weather conditions such as wind, cold and rain.

Briefly described, the invention includes a weather seal for use in combination with a swingable closure in an access opening of the type having a generally rectangular form with means along one vertical side for swingably supporting the closure, the closure having inner and outer major faces and a bottom edge, the opening having a sill member extending across the bottom thereof below the bottom of the closure in its closed position, the weather seal comprising an elongated mounting member having first and second substantially planar legs fixedly attached to each other to form a generally L-shaped cross section, means defining openings through said first leg of said L-shaped member to receive fasteners for attaching said first leg to a vertical major surface of the closure with said second leg of said member extending generally horizontally beneath the bottom edge of the closure, an elongated, resilient, generally tubular seal member fixedly attached to the inner, upper surface of said second leg, said tubular seal member being between said second leg and the bottom edge of the closure and in contact therewith when said mounting member is attached to said closure, and a plurality of elongated resilient ribs fixedly attached to and protruding from the outer, lower surface of said second leg, said ribs extending along substantially the entire length of said leg, at least two of said ribs extending substantially perpendicularly to said outer surface thereof.

In order that the manner in which the foregoing and other objects are obtained in accordance with the invention can be understood in detail, particularly advantageous embodiments thereof will be described with reference to the accompanying drawings, which form a part of this specification and wherein.

Figure 1:
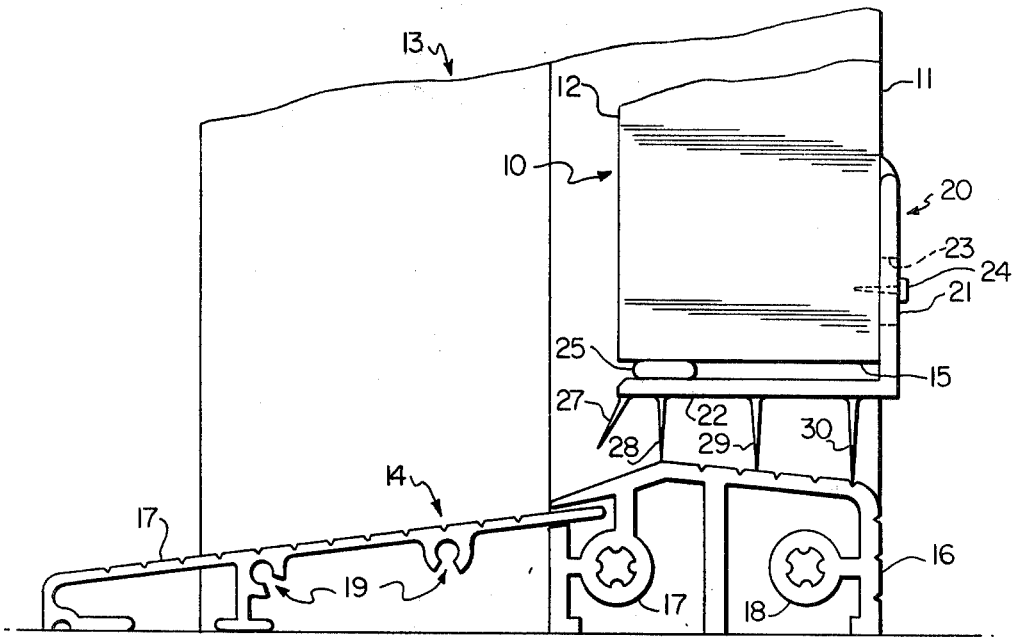
FIG. 1 is a partial side elevation of a closure swingable mounted in an access opening having a sill or threshold, the closure having mounted thereon a weather seal in accordance with the present invention.

Referring first to FIG. 1, it will be seen that the invention is used in conjunction with a closure, such as a conventional outside door indicated generally at 10 having an inner major face 11 and an outer major face 12, the terms "inner" and "outer" in this context referring to those faces which are directed toward the interior and exterior of the space to which access is had through the access opening. The opening itself includes side frame members indicated generally at 13, a top frame member, not shown in FIG. 1, and a bottom portion which normally is provided with a threshold or sill indicated generally at 14.

The door 12 has a bottom edge 15 which normally is a planar surface extending generally perpendicularly between faces 11 and 12, although it need not be precisely perpendicular to either face. The threshold or sill is advantageously formed by extrusion processes and, in the embodiment shown, includes an inner portion 16 and an outer portion 17, the inner portion being formed from a plastic such as polyvinyl chloride or any of a plurality of relatively rigid plastics commonly known as "vinyl" and is provided with vertical support walls and means 17 and 18 for receiving threaded fasteners through the side members of the door. The outer portion 17, being exposed to weather and wear, can advantageously be extruded from a metal such as aluminum and similarly has vertical support walls and means indicated generally at 19 for receiving fasteners. This particular form of fastener receiving means is especially suitable for use with a door frame which is a pre-assembled unit wherein the threshold is attached through the side wall portions before installation.

It will be observed that the upper surface of the sill has a relatively long sloping outer surface, formed by the upper portions of members 17 and part of member 16, and an inwardly sloping surface, the apex between these sloping surfaces being beneath the door 11 when the door is in its closed position, as shown.

Figure 2:
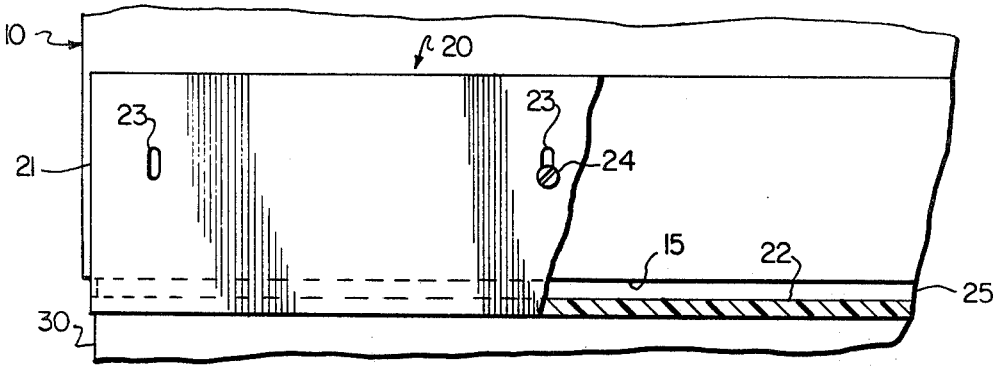
FIG. 2 is a partial front elevation, partially cut away, of the sweep and closure shown in FIG. 1.

Attached to the door is a sweep indicated generally at 20 in accordance with the present invention, the sweep including a first leg 21 and a second leg 22, each of these legs being elongated generally rectangular pieces which are fixedly attached to each other along one edge to form a member which is generally L-shaped in cross section. Leg 21 of this member is provided with means defining a plurality of openings 23, better seen in FIG. 2, through which fasteners 24, such as screws, can be inserted to attach the weather seal to the door. Openings 23 are elongated in a vertical direction, perpendicular to the elongated dimension of the weather seal, to permit vertical adjustment thereof.

When mounted on the door, leg 22 has an upper, or inner surface and a lower, or outer surface. A tubular seal member 25 is attached, as by adhesive, to the upper surface of leg 22 near the edge thereof opposite its connection to leg 21. Tube 25 is an elongated member which is substantially the same length as the L-shaped portion itself and, when installed, lies between leg 22 and the bottom edge 15 of the door and is partially compressed so as to prevent moisture or dirt from entering the space between leg 22 and the bottom edge.

A plurality of ribs 27, 28, 29 and 30 are fixedly attached to and protrude downwardly from the bottom surface of leg 22, ribs 28, 29 and 30 being generally perpendicular to the bottom surface of leg 22 and rib 27 extends downwardly and outwardly at an angle of about 30° from the vertical from a line close to the distal edge of leg 22.

The sweep structure as thus described is advantageously formed by an extrusion process using a plastic such as polyvinyl chloride or any of a number of other plastic materials which are resilient and flexible when thin but are reasonably rigid in a thicker construction. Legs 21 and 22 and ribs 27–30 can thus all be formed as an integral structure by an extrusion process, and tube 25 can be extruded as an integral portion of this structure as well. Alternatively, tube 25 can be separately formed and subsequently adhered to leg 22.

Figure 3:
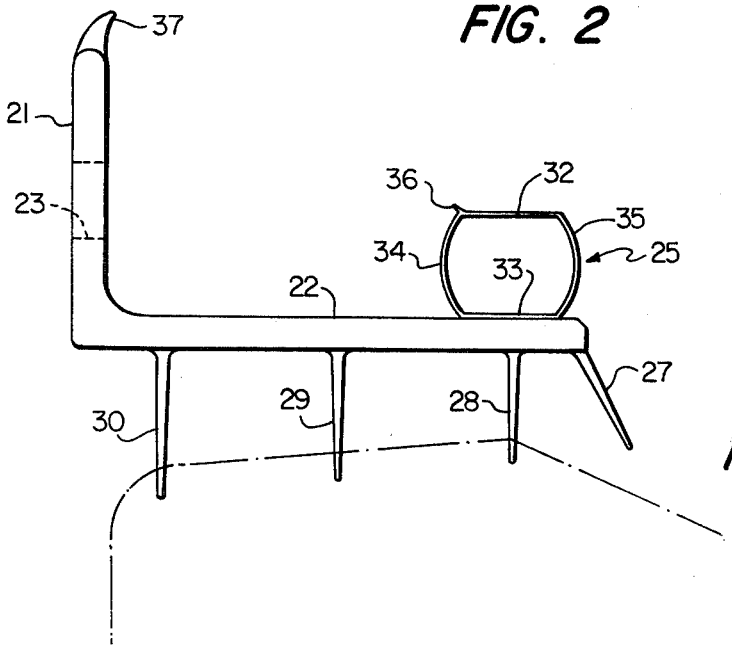
FIG. 3 is a side elevation, from the opposite side, of a sweep in accordance with FIGS. 1 and 2, the sweep being shown in enlarged form before attachment to a closure.

FIG. 3 shows an end view, reversed from the view of FIG. 1, of the weather seal apart from the door. As seen in FIG. 3, rib 27 extends at an angle of approximately 30° with vertical and acts as a flange to direct water outwardly and downwardly onto the sloping surface of the sill structure. Also as seen in FIG. 3, tube 25 is formed with substantially planar upper and lower walls 32 and 33 and convex side walls 34 and 35, upper wall 32 having a rib 36 protruding outwardly therefrom approximately at the edge at which it joined wall 34 to provide additional sealing against the lower edge of the door.

It will also be observed that the upper edge of wall 21 is provided with a tapered projection 37 which is, because of its reduced thickness, more flexible than the remainder of member 21 and forms a tight seal against the inner surface of the door to prevent entry of moisture or dirt.

Typically, the wall thickness of members 21 and 22 is about 0.120 inches (3.0 millimeters) with the ribs 27–30 being approximately one-tenth of that thickness, tapering from a thicker root to a thinner distal edge to provide the desired flexibility.

Figure 4:
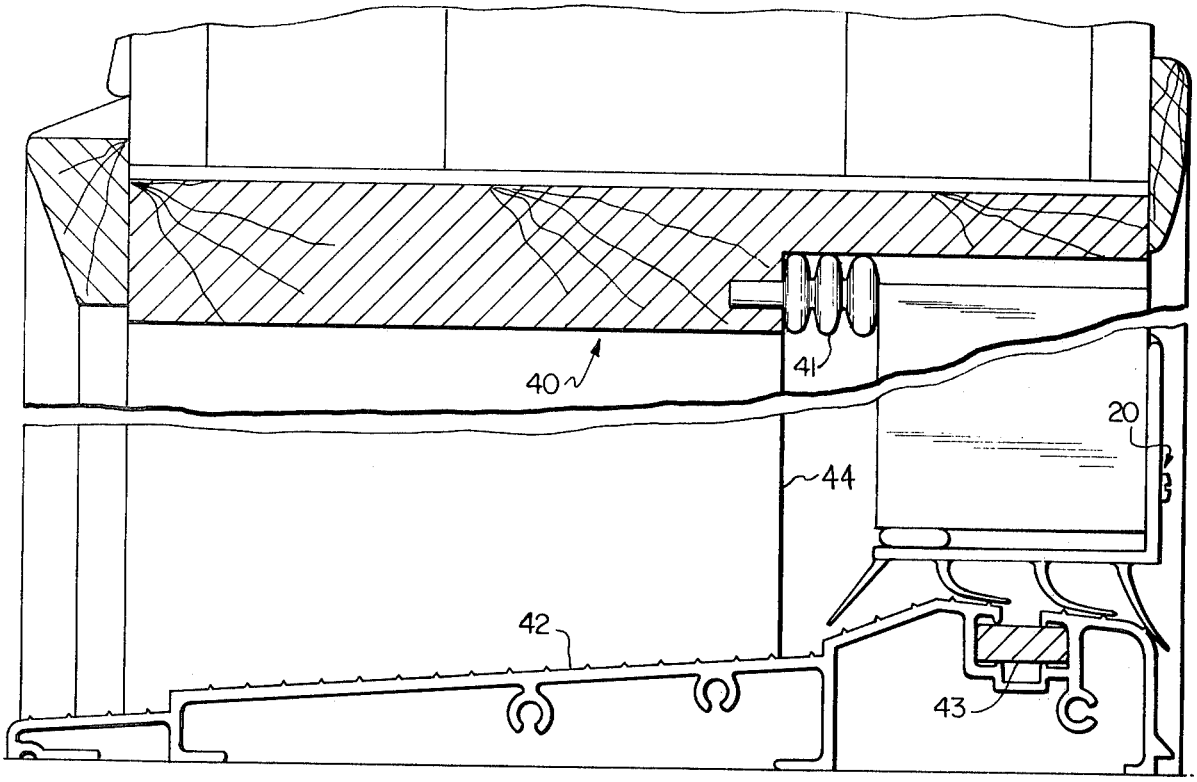
FIG. 4 is a foreshortened partial side elevation of a closure and access opening with a sweep in accordance with the present invention used in conjunction with an inwardly opening closure and a form of sill different from FIG. 1.

As previously mentioned, the arrangement of FIG. 1 is illustrated with an inwardly opening door, leg 21 being attached to the inner surface of the door. FIG. 4 shows a similar arrangement for an inwardly opening door with a different form of threshold or sill structure. As shown in FIG. 4, the upper portion of the door frame, indicated generally at 40 includes various wooden components which do not form a part of the present invention and therefore will not be described in detail. Across the inner edge of a shoulder formed in the upper frame is a resilient seal 41 which is abutted by the door and which forms a weather seal at that point. The side member of the door, drastically foreshortened in FIG. 4, is indicated generally at 44, and it will be recognized that it is this portion of the frame structure which supports hinges to permit the door to be swingable into and out of the opening.

The threshold structure itself, as illustrated in FIG. 4 is a unitary extruded aluminum member 42 having supporting leg, fastener receiving means, and an insulating strip 43. As previously discussed, the outer surface thereof has an outwardly sloping portion of considerable length and the inner portion has a shorter sloping portion containing insulator 43, the apex of the two slopes being beneath the door in its closed position. The sweep itself is identical to that described with reference to FIG. 1 and will not be discussed further. It will be observed that the mounting is also the same.

Figure 5:
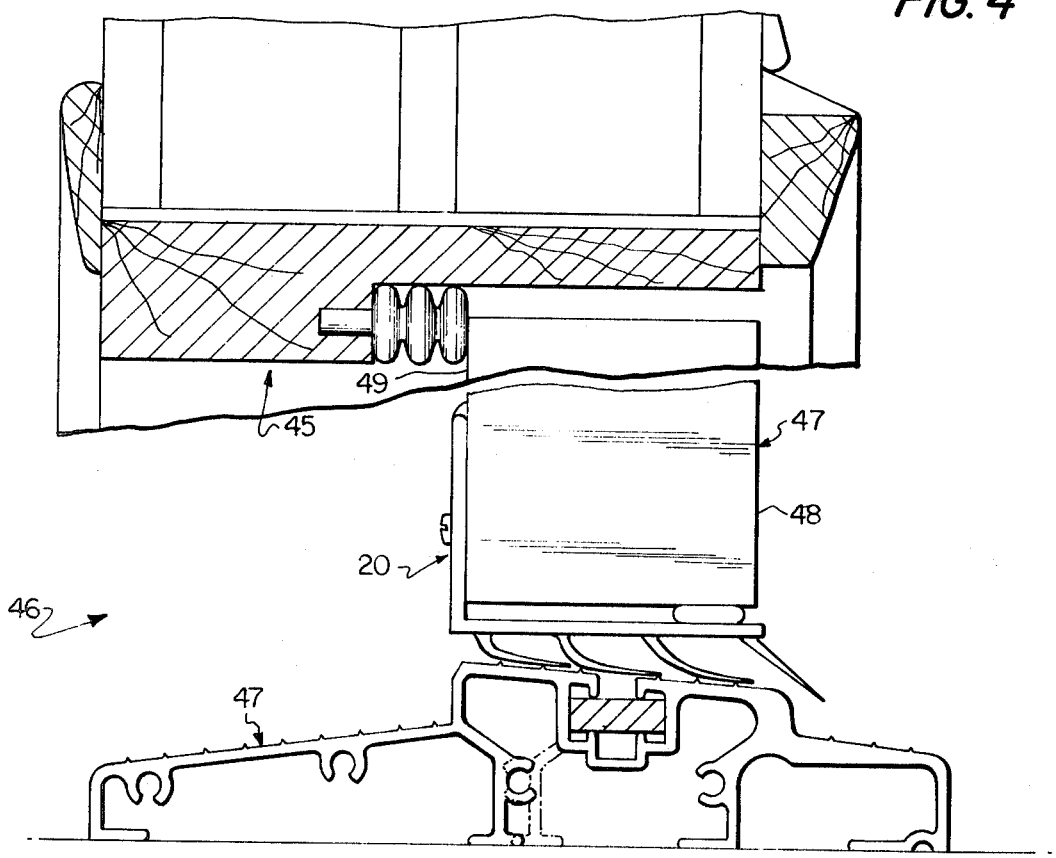
FIG. 5 is a foreshortened side elevation of a sweep in accordance with the invention mounted on a closure in an access opening having a further variety of sill.

FIG. 5 shows a door structure in which the door is designed to swing outwardly, i.e., to the right in FIG. 5. The door frame includes top members 45, vertical side members 46, and a bottom sill structure 47 which, again, is in a different form from that shown in FIGS. 1 and 4. In FIG. 5, the door 47 has an outer surface 48 and an inner surface 49, the sweep 20 being identical in construction to that shown in FIGS. 1 and 3. It is significant, however, that the sweep need only be reversed and mounted on the inside of the door, as before, and that no other modifications are necessary. Since the ribs 28–30 are capable of being resiliently moved in either direction, they can accomplish the same function as with an inwardly swinging door with no structural modification whatever.

The sweep itself is dimensioned in its elongated direction, i.e., that perpendicular to the paper in FIG. 3, such that it extends substantially entirely across the bottom of the door. The sweep can be produced in cut lengths suitable for installation on doors of various sizes, or alternatively, can be provided in a length greater than the greatest anticipated door width and can be cut to size at the time of installation, using any conventional cutting tool capable of cutting through the plastic.

While certain advantageous embodiments have been chosen to illustrate the invention it will be understood by those skilled in the art that various changes and modifications can be made therein without departing from the scope of the invention as defined in the appended claims.

What is claimed is:

1. A weather seal for use in combination with a swingable closure in an access opening of the type having a generally rectangular form with means along one vertical side for swingably supporting the closure, the closure having inner and outer major faces and a bottom edge, the opening having a sill member extending across the bottom thereof below the bottom of the closure in its closed position, the weather seal comprising an elongated mounting member having first and second substantially planar legs fixedly attached to each other to form a body having a generally L-shaped cross section;

means defining openings through said first leg of said L-shaped member to receive fasteners for attaching said first leg to a vertical major surface of the closure with said second leg of said member extending generally horizontally beneath the bottom edge of the closure;

a tapered projection on an upper edge of said first leg for forming a seal against a vertical major surface of the closure;

an elongated, resilient, hollow tubular seal member fixedly attached to the inner, upper surface of said second leg, said tubular seal member being between said second leg and the bottom edge of the closure and in contact therewith when said mounting member is attached to said closure; and a plurality of elongated resilient ribs fixedly attached to and protruding from the outer, lower surface of said second leg, said ribs extending along substantially the entire length of said leg, at least two of said ribs extending substantially perpendicular to said outer surface thereof.

2. A weather seal according to claim 1 wherein said openings through said first leg are elongated in a direction perpendicular to the longitudinal dimension of said weather seal, whereby said weather seal can be adjusted vertically to partially compress said tubular seal member between said second leg and the bottom edge of said closure.

3. A weather seal for use in combination with a swingable closure in an access opening of the type having a generally rectangular form with means along one vertical side for swingably supporting the closure, the closure having inner and outer major faces and a bottom edge, the opening having a sill member extending across the bottom thereof below the bottom of the closure in its closed position, the weather seal comprising an elongated mounting member having first and second substantially planar legs fixedly attached to each other to form a body having a generally L-shaped cross section;

means defining openings through said first leg of said L-shaped member to receive fasteners for attaching said first leg to a vertical major surface of the closure with said second leg of said member extending generally horizontally beneath the bottom edge of the closure;

an elongated, resilient generally tubular seal member fixedly attached to the inner, upper surface of said second leg, said tubular seal member being between said second leg and the bottom edge of the closure and in contact therewith when said mounting member is attached to said closure, said tubular seal member including an elongated tube having upper and lower substantially planar walls, and first and second convex side walls interconnecting said upper and lower walls, said lower wall being attached to said second leg; and a plurality of elongated resilient ribs fixedly attached to and protruding from the outer, lower surface of said second leg, said ribs extending along substantially the entire length of said leg, at least two of said ribs extending substantially perpendicular to said outer surface thereof.

4. A weather seal according to claim 3 wherein said elongated tube further comprises an elongated rib protruding from an edge of said upper planar wall.

* * * * *